US012139282B2

(12) United States Patent
Clarke et al.

(10) Patent No.: US 12,139,282 B2
(45) Date of Patent: Nov. 12, 2024

(54) PROCESS FOR MANUFACTURING A BLISTER STRIP FOR A DRY POWDER INHALER

(71) Applicant: VECTURA DELIVERY DEVICES LIMITED, Wiltshire (GB)

(72) Inventors: Roger Clarke, Cambridgeshire (GB); Darryl Cotton, Cambridgeshire (GB); Andreas Meliniotis, Cambridgeshire (GB)

(73) Assignee: VECTURA DELIVERY DEVICES LIMITED (GB)

( * ) Notice: Subject to any disclaimer, the term of this patent is extended or adjusted under 35 U.S.C. 154(b) by 114 days.

(21) Appl. No.: 17/798,224

(22) PCT Filed: Mar. 4, 2021

(86) PCT No.: PCT/EP2021/055445
§ 371 (c)(1),
(2) Date: Aug. 8, 2022

(87) PCT Pub. No.: WO2021/175983
PCT Pub. Date: Sep. 10, 2021

(65) Prior Publication Data

US 2023/0118029 A1 Apr. 20, 2023

(30) Foreign Application Priority Data

Mar. 6, 2020 (EP) ..... 20161461

(51) Int. Cl.
*B65B 11/52* (2006.01)
*B65B 1/04* (2006.01)
(Continued)

(52) U.S. Cl.
CPC ..... *B65B 11/52* (2013.01); *B65B 1/04* (2013.01); *B65B 7/164* (2013.01); *B65B 31/046* (2013.01); *B65B 61/06* (2013.01); *B65D 75/367* (2013.01)

(58) Field of Classification Search
CPC ..... B65D 75/367; A61M 15/0028; A61M 15/0051; B65B 11/52; B65B 61/06; B65B 31/046; B65B 7/164; B65B 1/04
(Continued)

(56) References Cited

U.S. PATENT DOCUMENTS 3,874,143 A 4/1975 Braber
4,211,329 A * 7/1980 Braverman ..... B65D 75/327 206/820
(Continued)

FOREIGN PATENT DOCUMENTS

GB 2 242 134 A 9/1991
WO WO 2005/037353 A1 4/2005
(Continued)

OTHER PUBLICATIONS

International Search Report from corresponding International Application No. PCT/EP2021/055445, mailed Apr. 23, 2021.
(Continued)

*Primary Examiner* — Chun Hoi Cheung
(74) *Attorney, Agent, or Firm* — Davidson Kappel LLC

(57) ABSTRACT

A process for producing a blister strip is provided. The blister strip contains two or more different formulations of powdered medicament for inhalation. The blister strip has a base in which blister cavities are formed. A first set of cavities each contain a first medicament formulation and are covered by a first lid material. A second set of cavities each contain a second medicament formulation and are covered by a second, separate lid material.

19 Claims, 9 Drawing Sheets

(51) Int. Cl.

| | |
|---|---|
| ***B65B 7/16*** | (2006.01) |
| ***B65B 31/04*** | (2006.01) |
| ***B65B 61/06*** | (2006.01) |
| ***B65D 75/36*** | (2006.01) |

(58) Field of Classification Search
USPC ..... 206/528–540
See application file for complete search history.

(56) References Cited

U.S. PATENT DOCUMENTS 5,042,472 A * 8/1991 Bunin ..... A61M 15/0043 D24/110.5
6,375,956 B1 * 4/2002 Hermelin ..... B65D 75/327 424/464
6,810,872 B1 * 11/2004 Ohki ..... A61M 15/0048 206/532
2009/0101145 A1 * 4/2009 Wachtel ..... A61M 15/0051 206/532
2012/0248005 A1 * 10/2012 Bergey ..... B65D 75/327 156/69
2017/0319434 A1 * 11/2017 Poddar ..... B65D 75/367

FOREIGN PATENT DOCUMENTS

WO WO 2009/092520 A1 7/2009
WO WO 2012/069854 A2 5/2012
WO WO 2013/175176 A1 11/2013
WO WO 2017/020321 A1 2/2017

OTHER PUBLICATIONS

Written Opinion of the International Searching Authority from corresponding International Application No. PCT/EP2021/055445, mailed on Apr. 23, 2021.

* cited by examiner

PROCESS FOR MANUFACTURING A BLISTER STRIP FOR A DRY POWDER INHALER

This application is a U.S. national phase application under 35 U.S.C. of § 371 of International Application No. PCT/EP/2021/055445, Mar. 4, 2021, which claims priority of European Patent Application No. EP 20161461.7, filed Mar. 6, 2020, the disclosures of which are hereby incorporated by reference herein.

TECHNICAL FIELD OF THE INVENTION

The present invention relates to a blister strip for a dry powder inhaler containing doses of two or more formulations for inhalation.

BACKGROUND TO THE INVENTION

Inhalers provide an attractive method for administering medicaments, for example to treat local diseases of the airway or to deliver drugs to the bloodstream via the lungs. The medicament is commonly provided as a dry powder in individual pre-packaged doses, such as capsules or blisters. Foil blisters are often preferred over capsules, since they provide protection from the ingress of water and penetration of gases such as oxygen, as well as shielding from light and UV radiation, all of which can have a detrimental effect on the properties of the powder. Furthermore, it is advantageous for the inhaler to hold a number of doses so that there is no need to insert a dose into the inhaler each time it is used. Therefore, many inhalers contain a number of doses in the form of a blister strip, as disclosed in, for example, WO 05/037353, WO 12/069854 and WO13/175176. Actuation of the inhaler causes a mechanism to index the strip and open a blister. When the patient inhales, air is drawn through the blister and entrains the powder, which is carried through the inhaler and into the patient's airway.

In the treatment of respiratory disorders it is often beneficial to administer a combination of active pharmaceutical ingredients (APIs) to a patient, for example a bronchodilator (such as salmeterol) and an anti-inflammatory drug (such as fluticasone), or a triple combination such as a long acting β2-agonist (LABA), a long-acting muscarinic antagonist (LAMA) and a corticosteroid. However, the APIs typically have very different physicochemical properties, which affects, for example, their interactions with carrier particles. Consequently, it is very difficult to co-formulate two (or more) APIs in a single powder with the desired aerosolization properties.

One way to circumvent this problem is separate the APIs. For example, WO 05/014089 discloses an inhaler which has two separate blister strips, each containing an independent drug blend. The strips are indexed and opened concurrently when the inhaler is actuated, so that the patient receives both APIs on inhalation. However, these inhalers are necessarily more complex than those which have a single blister strip.

WO 09/092520 discloses inhalers which can deliver two different inhalation formulations during each use from a single blister strip. The blisters are arranged in pairs of adjacent blisters; one blister of each pair contains the first formulation and the other contains the second formulation. The inhaler moves the blister strip onwards by two blisters in each actuation, and has two piercing elements for simultaneously piercing two blisters. Consequently, when the user actuates the inhaler, a dose of each formulation is delivered simultaneously. WO 09/092520 does not discuss how the blister strip is produced.

A conventional process for filling powdered medicament into blister strips involves passing a 2D sheet having rows of blister cavities under a series of filling heads, which fill rows of blisters. The filled cavities are sealed with a foil lid, and then the sheet is slit lengthwise into individual strips. A blister strip with two different formulations could be produced simply by putting the different formulations into different filling heads. However, when the powder is filled into the blisters, a small amount may be aerosolized and spread across the sheet. This could result in the transfer of small amounts powder into the wrong blisters, which in turn could lead to deterioration of the properties of the powder as a result of incompatibility between the formulations. Therefore, a different approach is needed for producing a blister strip that contains two (or more) different formulations in separate blisters.

BRIEF DESCRIPTION OF THE INVENTION

The present invention addresses this problem, and provides a process for forming a blister strip with blisters containing two or more different formulations. The blister strip comprises a base material in which the blister cavities are formed and a lid material which seals the cavities.

In a first aspect, the invention provides a process for producing a blister strip for a dry powder inhaler, the blister strip comprising a base material having blister cavities, the process comprising dosing a first formulation of medicament into a first set of blister cavities and sealing a first lid material to the first set of cavities into which the first formulation was dosed; and subsequently dosing a second, different formulation of medicament into a second set of cavities and sealing a second, separate lid material to the second set of cavities into which the second formulation was dosed.

The base material may be a sheet having a plurality of rows of blister cavities, and the first and second sets of cavities each comprises one or more of the rows. The base material may be a continuous sheet which is passed along a process line which comprises:

- a forming station for forming the blister cavities in the base material;
- a first filling head, for dosing the first formulation into the first set of cavities;
- a first sealing tool for sealing the first lid material to the first set of cavities;
- a second filling head for dosing the second formulation into the second set of cavities;
- a second sealing tool for sealing the second lid material to the second set of cavities; and
- cutting means for cutting the base material into blister strips.

The process line may further comprise an air jet or vacuum cleaning head between the first sealing tool and the second filling head for removing any of the first formulation that may have entered the second set of cavities.

The first lid material may be applied transversely with respect to the direction of the process line. Alternatively the first lid material may be applied longitudinally, in which case it has holes that correspond to the locations of the second set of cavities. The second lid material may be applied transversely. Alternatively the second lid material may be applied longitudinally, in which case it may have holes corresponding to the locations of first set of cavities.

In a second aspect, the invention provides a blister strip for a dry powder inhaler comprising a base material having blister cavities, wherein a first set of the blister cavities contains a first formulation of medicament and is covered by a first lid material and a second set of cavities contains a second, different formulation of medicament and is covered by a second, separate lid material.

The first and second sets of cavities may be arranged in an alternating pattern (ABABAB). Alternatively, the first and second sets of cavities may each be arranged in pairs and the pairs form an alternating pattern (AABBAABB).

The first and second lid materials may be in the form of discrete pieces which cover each blister cavity or each pair of blister cavities.

The first lid material may be in the form of discrete pieces which cover each blister cavity or each pair of blister cavities containing the first formulation and the second lid material may be in the form of a continuous piece that optionally has holes that correspond to the locations of the first set of blister cavities containing the first formulation.

The first lid material may be in the form of a continuous piece that covers each blister cavity or each pair of blister cavities containing the first formulation and has holes that correspond to the second set of blister cavities containing the second formulation; and the second lid material may be in the form of a continuous piece that optionally has holes that correspond to the locations of the first set of blister cavities containing the first formulation.

The first and second lid materials may be the same or may be different materials, e.g. the same type of foil or foil laminate, or different types of foil or foil laminate, and should be able to form a seal with the base material and/or the other lid material as required.

Additional filling head(s), sealing tool(s) and air jet or vacuum cleaning head(s) can be included in order to produce a blister strip containing three (or more) different formulations, for example in an ABC arrangement.

BRIEF DESCRIPTION OF THE FIGURES

The invention will now be further described with reference to the Figures, wherein.

DETAILED DESCRIPTION OF THE INVENTION

Figure 1:
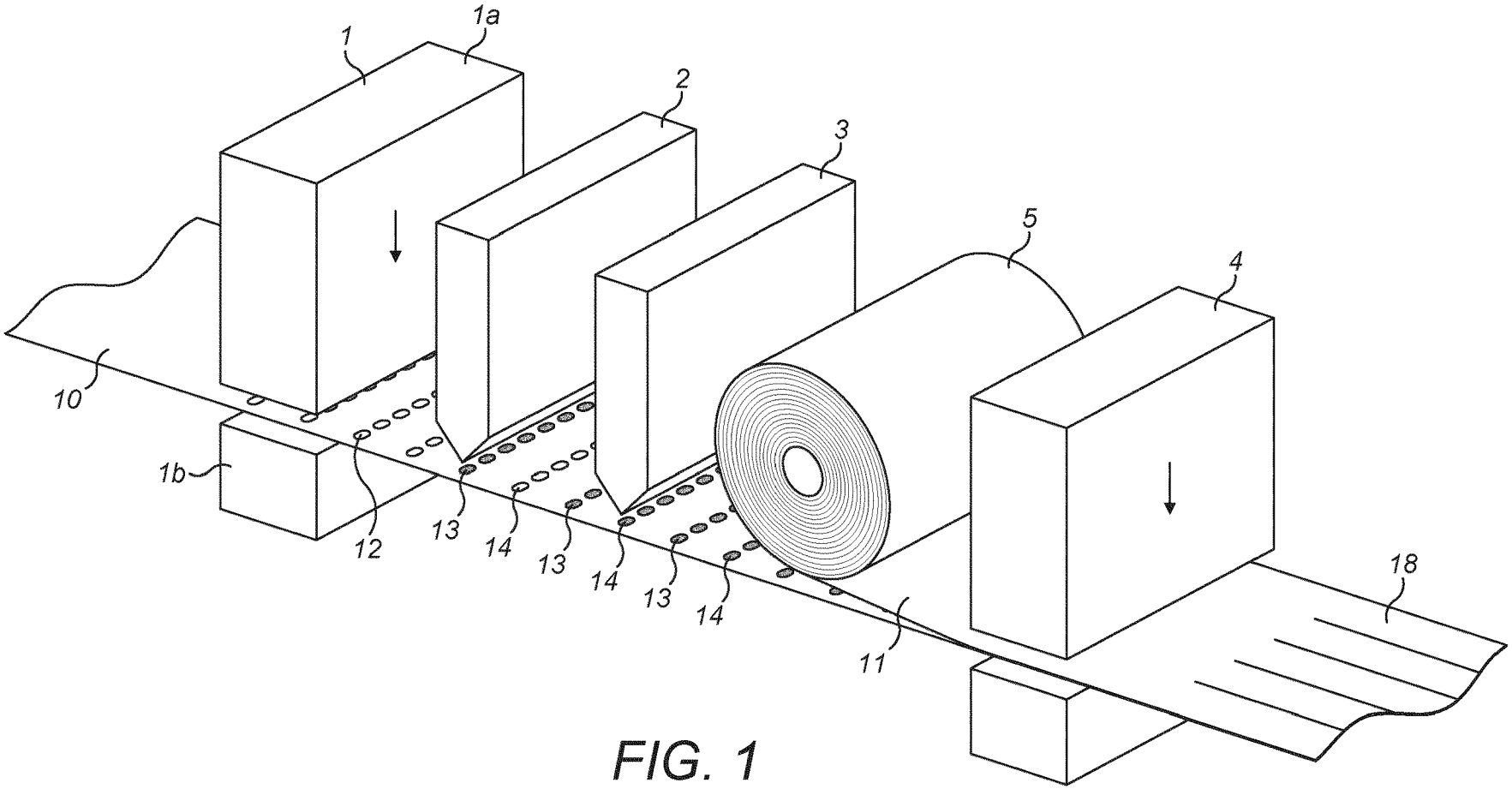
FIG. 1 shows a conventional process for producing blister strips containing a single formulation.

The term "blister strip" means an elongate strip comprising a plurality of spaced blister cavities containing individual doses of medicament in dry powdered form for inhalation. A blister strip generally comprises a base having a number of spaced apart cavities and a lid in the form of a generally planar sheet. The lid is sealed to the base except in the region of the cavities, for example by using a heated sealing tool which compresses the base and lid material together in a region surrounding each cavity so that the lid is sealed to the base. The strip is for use in an inhaler device equipped with an indexing mechanism for advancing the blisters sequentially to an opening station to enable the medicament to be accessed and inhaled by a patient. The blister strip is preferably sufficiently flexible to enable it to be wound into a roll for insertion into the inhaler.

Inhalers used to treat a respiratory disease such as asthma or COPD typically usually contain sufficient doses for at least one month's treatment, so that the blister strip typically has 30 doses. For a combination therapy with two different formulations in which a pair of blisters provides a single dose, a blister strip with 60 blisters is needed to provide 30 doses. An inhaler such as that disclosed in WO 09/092520 indexes and pierces two blisters on each actuation. It may do this by means of two piercing elements, one for each of the two blisters that are pierced in a single actuation. The piercing elements may be identical, but may also be different, for example if it is desired to create openings of different sizes in the two blisters, due to the different properties of the two formulations. Alternatively, the lid may be peeled away from the base of the strip to enable access to the dose, as in GB2242134, or the lid may be burst open by folding the base, as in WO 17/020321.

For a triple combination therapy, the inhaler may have three piercing elements and the indexing mechanism may be correspondingly arranged to move the blister strip by three blisters on each actuation. Thus the inhaler can deliver three different formulations in a single actuation. Alternatively, the inhaler could provide a double dose of one formulation and a single dose of another. Furthermore, it is possible to use a blister strip containing four different formulations by indexing and piercing four blisters. Other numbers and combinations of blisters are also possible, and those skilled in the art will be able to adapt the blister strip and inhaler accordingly.

The base material is typically a laminate comprising a polymer layer in contact with the drug, a soft tempered aluminium foil layer and an external polymer layer, as described for example in WO 06/108876. The aluminium provides a barrier to ingress of moisture, oxygen and light, whilst the polymer aids the adherence of the foil and provides a relatively inert layer in contact with the drug. Suitable materials for the polymer layer in contact with the drug include polyvinylchloride (PVC), polypropylene (PP) and polyethylene (PE). The polymer layer in contact with the drug is typically PVC of 30 μm thickness. However, a thicker or thinner layer of e.g. 60 μm or 15 μm may be used where a stiffer or more flexible laminate is required. Soft tempered aluminium is ductile so that it can be cold-formed into a blister shape. It is typically 45 μm thick. The external polymer layer provides additional strength and toughness to the laminate, and is typically made from oriented polyamide (oPA), typically 25 μm thick.

The lid material is typically foil or a foil laminate comprising a heat seal lacquer, a hard rolled aluminium layer and a top layer of primer, as described for example in WO 06/108876. The heat seal lacquer bonds to the drug-contacting polymer layer of the base laminate during sealing to provide a seal around the top of the blister cavity. If the polymer layer in contact with the drug in the base material is PE, the heat seal lacquer on the lid material may be replaced with a further layer of PE. On heat-sealing, the two layers of PE melt and weld to each other. The aluminium layer is typically 20-30 μm thick, and is hard rolled to facilitate piercing of the blister by the inhaler. The primer facilitates printing onto the strip, for example blister numbers.

FIG. 1 illustrates a conventional process for producing blister strips containing a single formulation. The production line has a forming tool 1, two filling heads 2, 3 and a sealing tool 4. A sheet of the base material 10 passes along the production line from left to right. A roll 5 of the lid material 11 is located between the second filling head 3 and the sealing tool 4.

The sheet of base material 10 first passes through the forming station where it is cold formed to create rows of blister cavities 12 by moving the upper part 1*a* of the forming tool 1 downwards so that the base material is pressed between the upper 1*a* and the lower 1*b* parts. Then the formed base sheet passes under the filling heads 2, 3. Each filling head dispenses measured amounts of powder into a row of cavities. The two filling heads are spaced apart by an odd number of blister pitches (i.e. the distance between the centres of adjacent blister cavities in the longitudinal direction of the base sheet), and the base sheet is advanced by two blister pitches in each step. Thus the first filling head fills odd numbered rows 13 and the second filling head fills even numbered rows 14 of blister cavities. In practice, there may be a larger number of filling heads, for example six, in which case the base sheet advances by six blister pitches in each step. Next, the lid material 11 is dispensed from the roll 5 on top of the base sheet and is heat-sealed around the periphery of the blister cavities at the sealing tool 4. Knives (not shown) cut the formed, filled and sealed blister sheet longitudinally into blister strips 18 as it advances, and also transversely to the required length.

It would be possible to produce a blister strip with two (or more) different formulations, by simply putting the different formulations into the two filling heads. For example, the first, filling head could contain the first formulation (A) and the second filling head could contain the second formulation (B). The resulting blister strip would have an alternating ABAB sequence of formulations. However, when the powder is filled into the cavities, a small amount may be aerosolized and spread across the base sheet. This could result in the transfer of small amount of formulation A into the blisters containing formulation B, and vice versa. This in turn could lead to deterioration of the properties of the powder as a result of incompatibility between the formulations.

Figure 2:
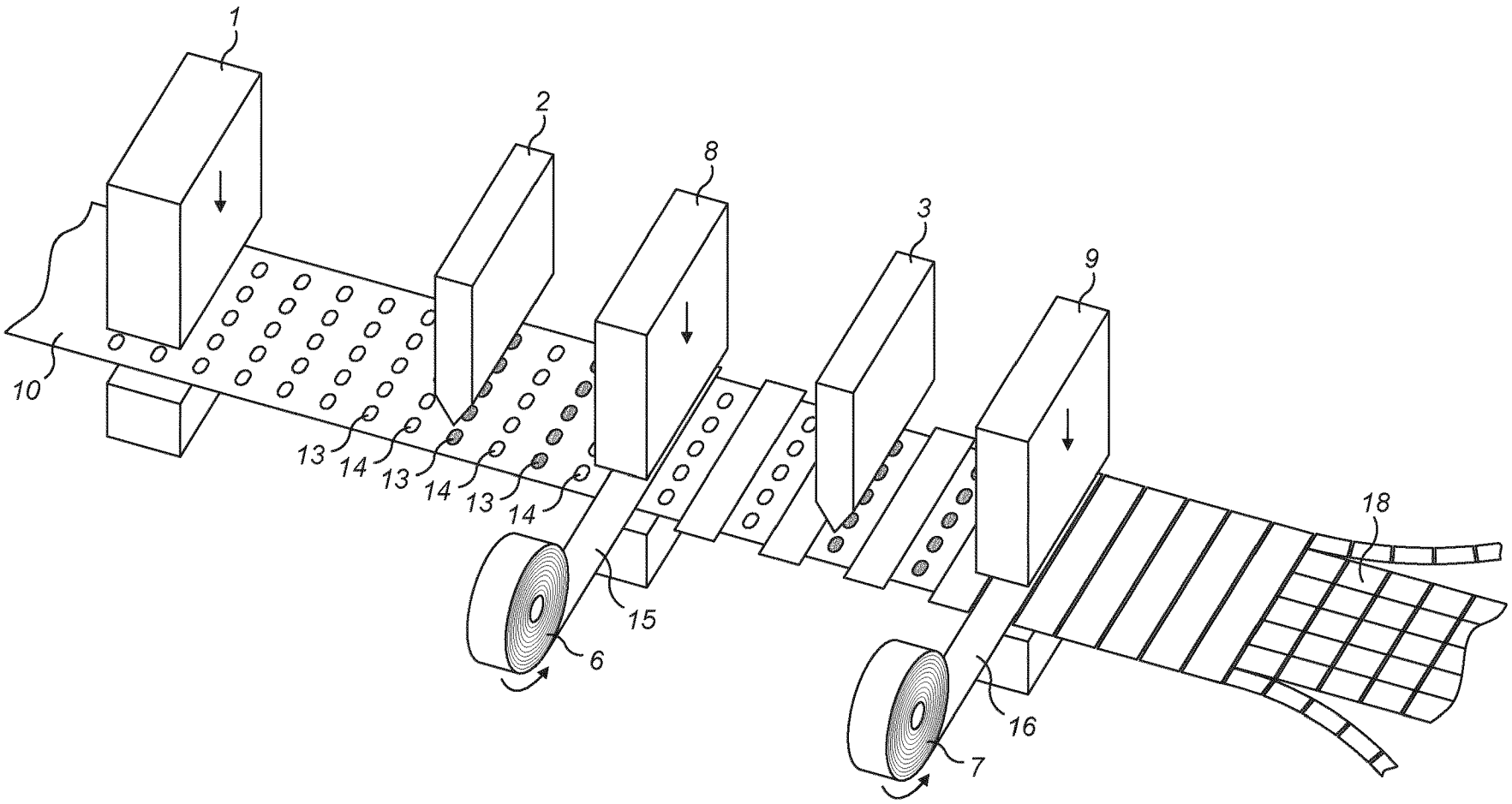
FIG. 2 shows a first process according to the invention for producing blister strips containing two different formulations in alternate blisters.

FIG. 2 shows a process line in accordance with the invention for producing blister strips containing two different formulations in alternate blisters. The line differs from the conventional process line of FIG. 1 in that there are two separate rolls 6, 7 of lid material and two separate sealing tools 8, 9. The first roll 6 and first sealing tool 8 are located between the first filling head 2 and the second filling head 3. The second roll 7 and second sealing tool 9 are situated downstream of the second filling head 3. The first and second filling heads contain formulations A and B respectively. The first and second rolls 6, 7 are located to one side of the process line. The first and second lid materials may be the same or they may be different.

The blister cavities are formed and filled in the same way as in the conventional process, however the lid is applied in a different way, namely in two stages. After the odd numbered rows 13 of blister cavities have been filled with formulation A at the first filling head 2, a strip of lid material 15 is pulled from the first roll 6 transversely across the sheet. This is heat-sealed around the cavities at the first sealing tool 8, and then cut at the edge of the sheet. The width of the strip typically corresponds to one blister pitch. Then the second filling head 3 fills the even numbered rows 14 with formulation B. A second strip of lid material 16 is pulled from the second roll 7 transversely across the sheet, heat-sealed at the second sealing tool 9 and cut at the edge of the sheet. Finally, the filled and sealed blister sheet is slit longitudinally and cut transversely to form blister strips 18, as before. The second strip of lid material may or may not overlap the first lid material. If it does overlap, it preferably forms a seal not only with the base material, but also with the top surface of the first lid material in the region of overlap. Consequently, the first lid material may have an additional top layer, for example of PE, to form the seal. Since the blister cavities that contain formulation A are sealed before the second filling head, there is no transfer of formulation B into formulation A. An air jet or vacuum cleaning head (not shown in FIG. 2) may be located between the first sealing tool 8 and the second filling head 3 in order to remove any formulation A that may have entered the even-numbered cavities. Thus there is no transfer of powder to the wrong blisters.

Figure 3:
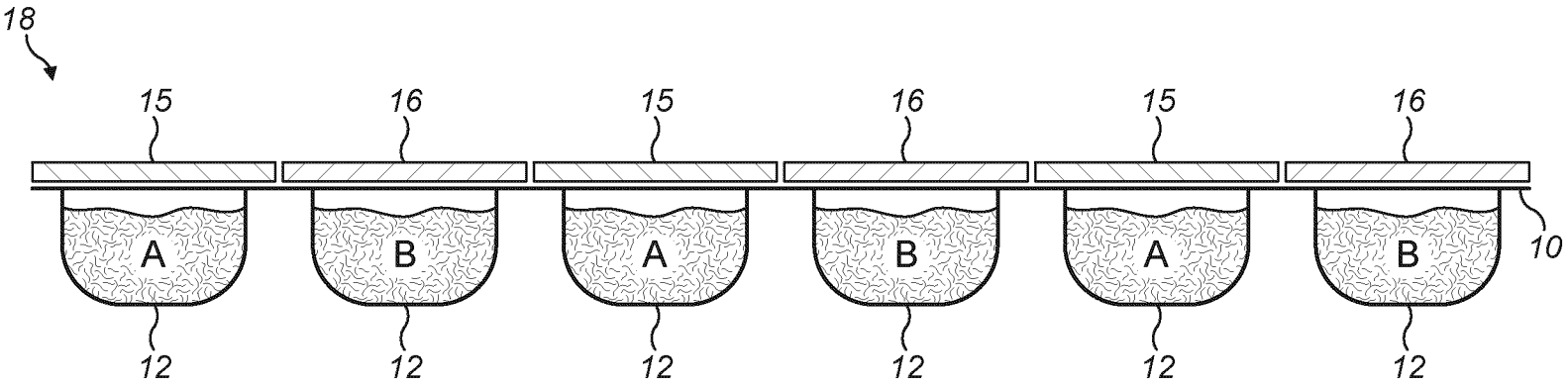
FIG. 3 shows a blister strip produced by the process of FIG. 2.

FIG. 3 schematically shows a blister strip 18 produced according to the process of FIG. 2 (the lid material is shown as much thicker than it is in reality for illustration). The blisters 12 contain the first (A) and second (B) formulations in an alternating sequence (ABABAB). The blister cavities containing formulation A are covered with the first lid material 15 and those containing formulation B are covered with the second lid material 16. Typically the two formulations contain different APIs, although the formulations could also, for example, have different particle sizes and/or different excipients and/or be prepared by different processes. The ABAB blister configuration has the advantage that each piercing element in the inhaler, and the associated airway to the mouthpiece, always interacts with the same formulation (i.e. either A or B, but not A in one actuation and then B in the next). Therefore the piercer and airway can be designed to be optimal for that particular formulation.

Figure 4:
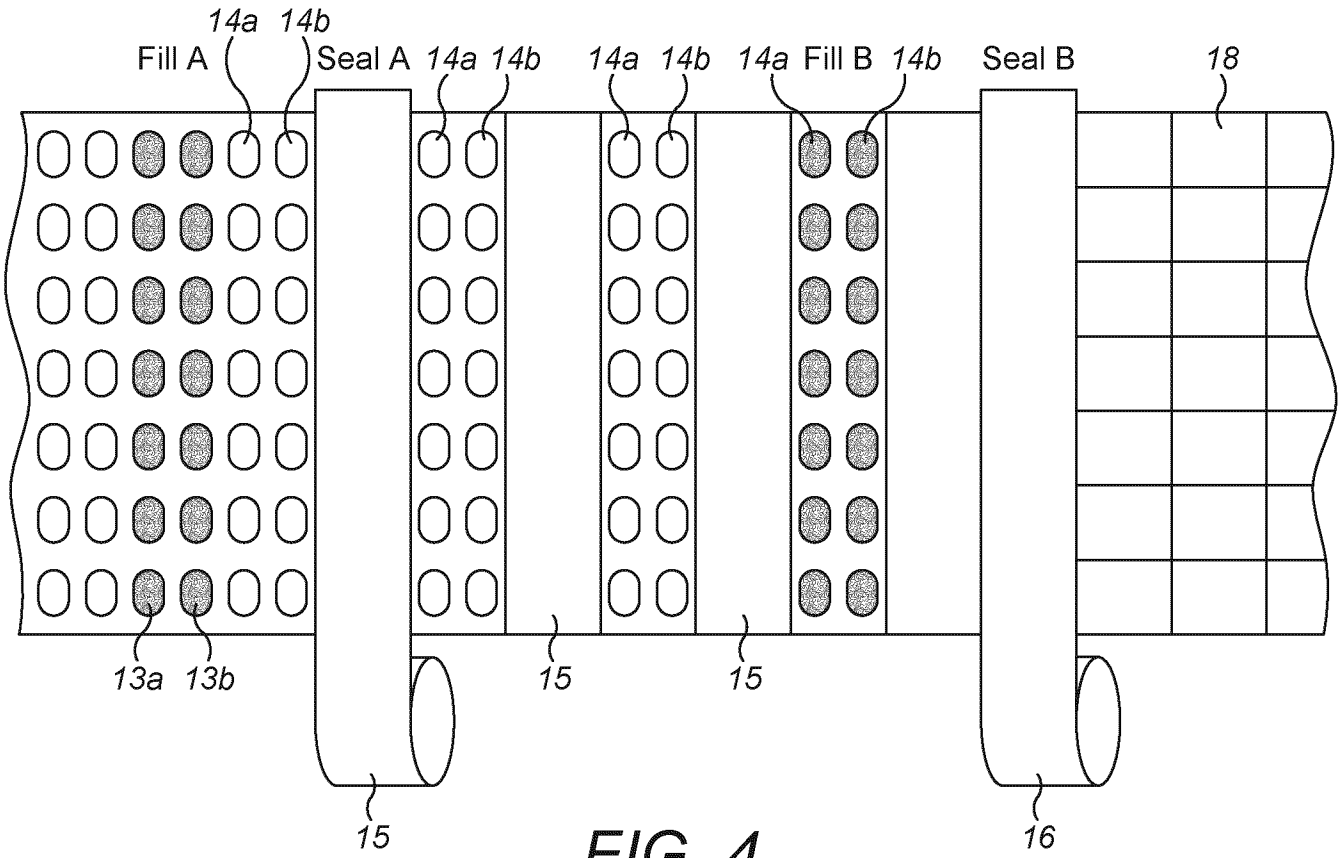
FIG. 4 shows a variant of the process of FIG. 2, in which the blister strips contain two different formulations in alternate pairs of blisters.
Figure 5:
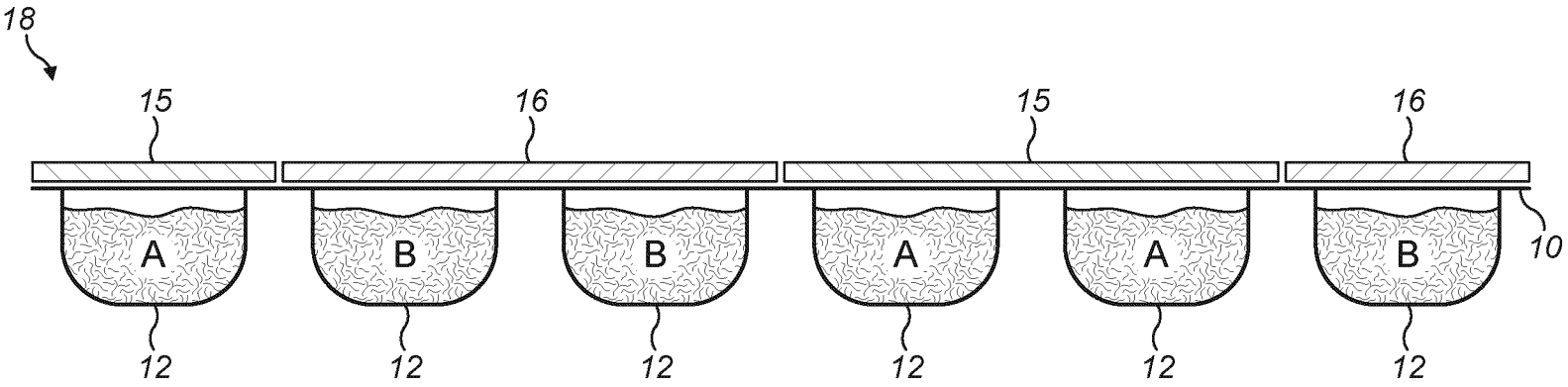
FIG. 5 shows a blister strip produced by the process of FIG. 4

FIG. 4 schematically shows a variant on the process of FIG. 2. In this process, the first and second filling heads each fill two adjacent rows of blisters 13*a*, 13*b*, 14*a*, 14*b* and the strips of lid material 15, 16 have a width corresponding to two blister pitches. As with the previous embodiment, the second strip of lid material may also be wider so that it overlaps the first lid material. As shown in FIG. 5, the resulting blister strip 18 contains the first and second formulations in alternate pairs of blisters (i.e. AABBAABB). The blister cavities containing formulation A are covered with the first lid material 15 and those containing formulation B are covered with the second lid material 16. This embodiment has the advantage that the number of sealing operations is halved, whilst it is still possible to deliver the two formulations simultaneously. The blister strip is arranged in the inhaler so that the first two blisters to be opened are AB. The next two blisters to be opened are BA. In each case, one blister of formulation A and one of formulation B is delivered. In this embodiment, each piercing element and airway interacts with formulation A in one actuation and then formulation B in the next.

Figure 6:
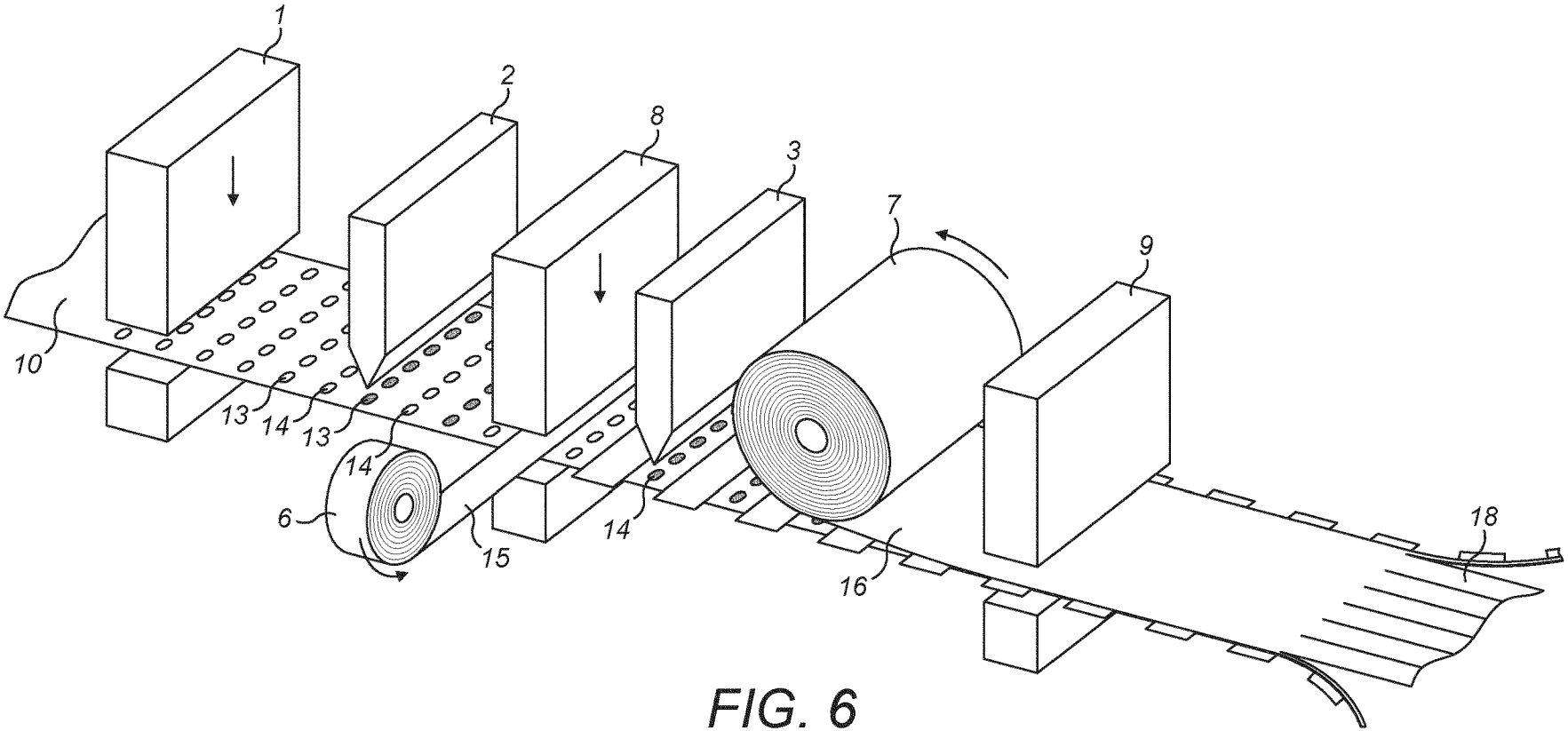
FIG. 6 shows a second process according to the invention for producing blister strips containing two different formulations in alternate blisters.

FIG. 6 shows another process according to the invention. In this embodiment, the forming tool 1, first and second filling heads 2,3, first roll 6, and first sealing tool 8 are the same as in FIG. 2. However, the second roll 7 is configured as in the conventional process of FIG. 1. The blister cavities are formed and filled in the same way as in the first embodiment. The second lid material 16 is dispensed continuously in the longitudinal direction, rather than in transverse strips, so that it is applied on top of the base material 10 and the strips of the first lid material 15. In this embodiment, the second lid material forms a seal with the base material, and also with the top surface of the first lid material. The second lid material may be the same as the first lid material, or it may be different.

Figure 7:
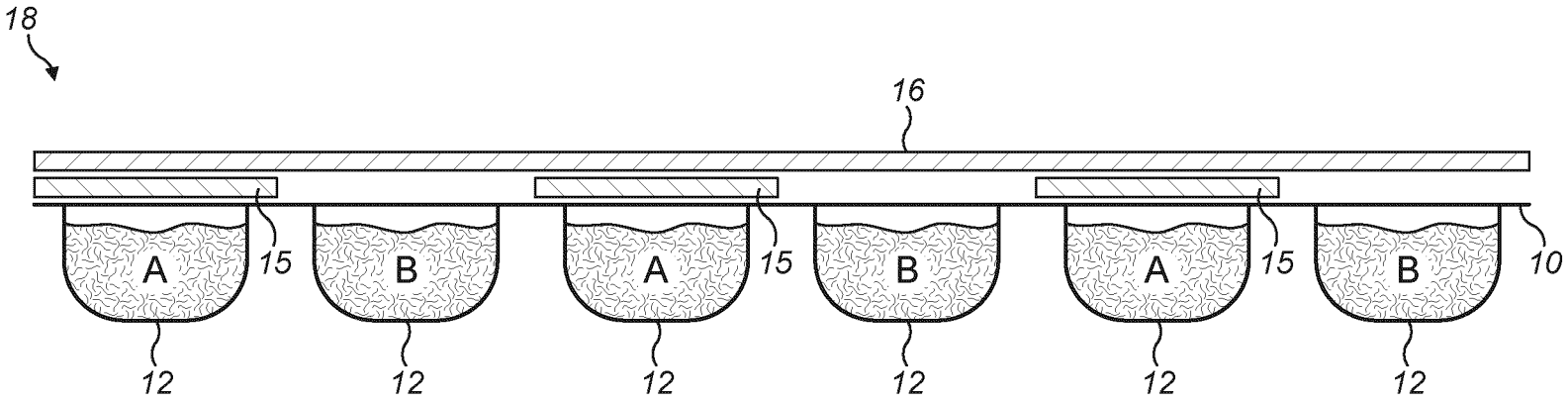
FIG. 7 shows a blister strip produced by the process of FIG. 6.

FIG. 7 schematically shows a blister strip resulting from the process of FIG. 6. The blisters 12 contain the first (A) and second (B) formulations in an alternating sequence (ABABAB) as in FIG. 3. The first lid material 15 covers the blister cavities containing formulation A. The second lid 16 material extends across the whole blister strip, so that it covers both sets of blister cavities. Consequently, the blisters containing formulation A have a double layer of lid material. As before, the lid material is shown as much thicker than it is in reality for illustration; moreover, in reality, the second lid material 16 comes into contact with and is sealed to the base material 10 around the blister cavities that contain formulation B.

Figure 8:
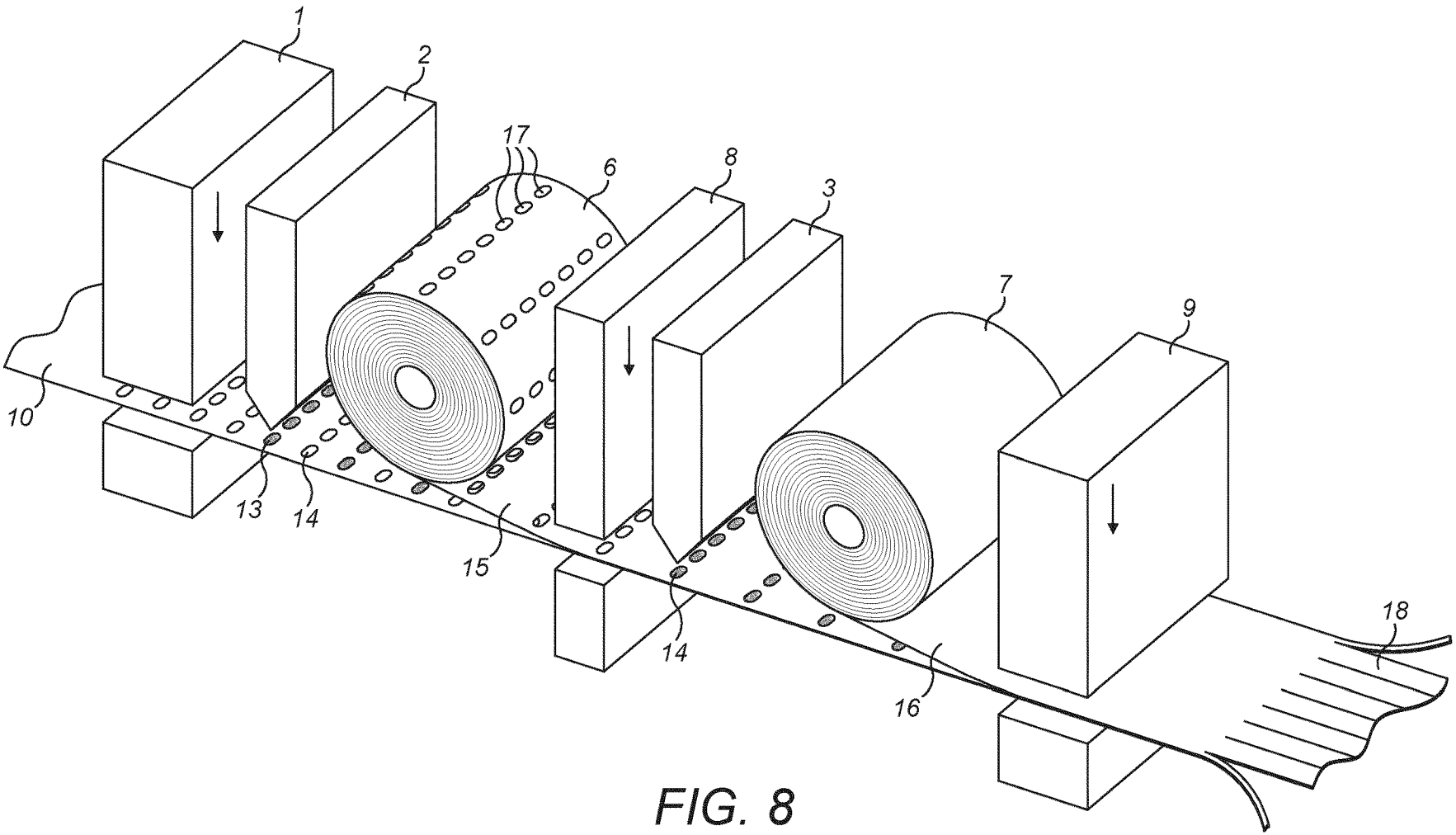
FIG. 8 shows a third process according to the invention for producing blister strips containing two different formulations in alternate blisters.

FIG. 8 shows another process according to the invention. In this embodiment, the forming tool 1, first and second filling heads 2, 3, second roll 7 and second sealing tool 9 are the same as in FIG. 6, but the first roll 6 is also arranged to dispense the first lid material longitudinally. The odd-numbered rows 13 of blister cavities are filled with formulation A in the same way as before. Then the first lid material is dispensed continuously in the longitudinal direction, rather than in transverse strips. The first lid material has preformed holes 17 which align with the even numbered rows of blister cavities 14 so that formulation B can be subsequently dispensed into them. The holes may correspond to one or more cavities, for example a large hole corresponding to a row of cavities. Alternatively, the first lid material could be a continuous sheet in which the holes could be formed by a cutting tool (not shown in FIG. 8) located between the roll 6 and the first sealing tool 8. The first and second lid materials may be the same or may be different materials. The second lid material should be able to form a seal with the top surface of the first lid material.

Figure 9:
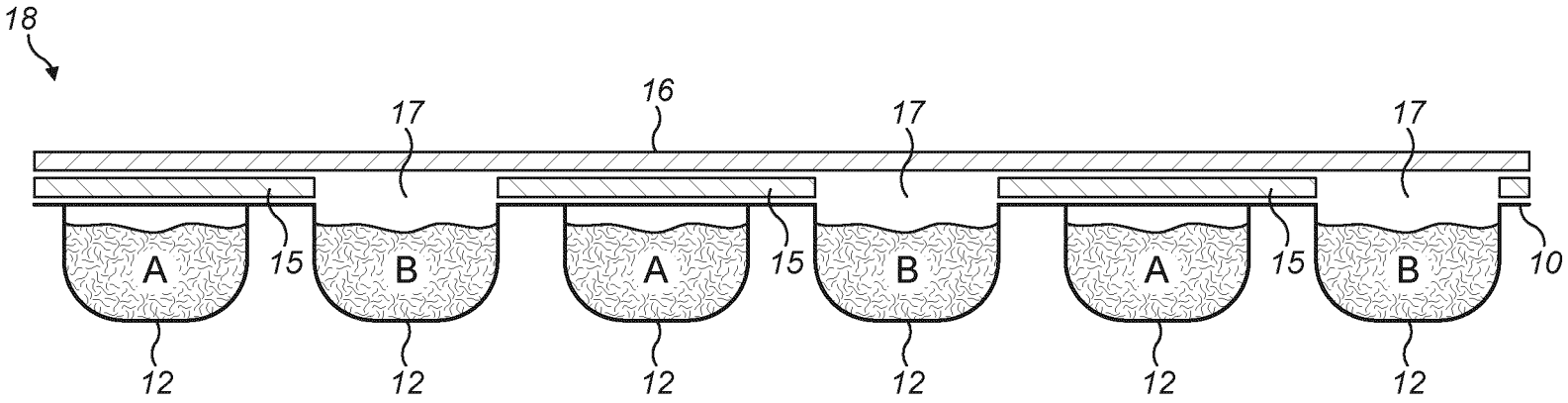
FIG. 9 shows a blister strip produced by the process of FIG. 8.

FIG. 9 schematically shows a blister strip produced by the process of FIG. 8. The blisters 12 contain the first (A) and second (B) formulations in an alternating sequence (ABABAB) as in FIG. 3. The first lid material 15 covers the blisters containing formulation A, and the holes 17 are located above the blisters containing formulation B. The second lid 16 material extends across the whole blister strip, so that it covers both sets of blisters. Hence the blisters containing formulation A have a double layer of lid material. Again, the lid material is shown as much thicker than it is in reality for illustration.

In FIG. 7 and FIG. 9, the blisters containing formulation A have two layers of lid material. Since the second lid material provides the main barrier to moisture and gas ingress, it is not necessary for the first lid material to be a foil laminate. Thus, the first lid material could simply be a covering layer, for example of the same material as the top layer of the base laminate (e.g. PVC, PP or PE). Depending on the strength and thickness of the first lid material, it may be necessary to adapt the blister opening mechanism of the inhaler in view of the additional lid layer; for example, a different piercing element may be required. Alternatively, the second lid material could have holes corresponding to individual blisters that contain formulation A, or corresponding to the rows of these blisters. Each blister thereby would have only a single layer of lid material, i.e. first and second lid materials cover the blisters containing formulations A and B respectively.

The processes of FIGS. 6 and 8 have the advantage that longitudinal dispensing of one or both lid materials is simpler to implement than transverse dispensing, and there is no need to cut the lid material(s) separately from the base sheet. These processes can be adapted to produce ABABAB or AABBAA configurations, according to whether one or two rows of blister cavities are filled and sealed in each part of the process, in the same manner as for FIG. 4.

An air jet or vacuum cleaning head (not shown in FIGS. 6 and 8) may be located between the first sealing tool and the second filling head to remove any of the first formulation that may have entered the second set of cavities.

One or more additional filling heads, rolls and sealing tools could be included in any of the embodiments in order to produce a blister strip containing three or more different formulations, for example in an ABC arrangement.

The medicaments are suitable for administration by inhalation, for example for the treatment of a respiratory disease. They may include one of more of the following classes of pharmaceutically active material: anticholinergics, adenosine A2A receptor agonists, β2-agonists, calcium blockers, IL-13 inhibitors, phosphodiesterase-4-inhibitors, kinase inhibitors, steroids, CXCR2, proteins, peptides, immunoglobulins such as Anti-IG-E, nucleic acids in particular DNA and RNA, monoclonal antibodies, small molecule inhibitors and leukotriene B4 antagonists. The medicament may include excipients, such as fine excipients and/or carrier particles (for example lactose), and/or additives (such as magnesium stearate, phospholipid or leucine).

Suitable β2-agonists include albuterol (salbutamol), preferably albuterol sulfate; carmoterol, preferably carmoterol hydrochloride; fenoterol; formoterol; milveterol, preferably milveterol hydrochloride; metaproterenol, preferably metaproterenol sulfate; olodaterol; procaterol; salmeterol, preferably salmeterol xinafoate; carmoterol; terbutaline, preferably terbutaline sulphate; vilanterol, preferably vilanterol trifenatate or indacaterol, preferably indacaterol maleate.

Suitable steroids include budesonide; beclamethasone, preferably beclomethasone dipropionate; ciclesonide; fluticasone, preferably fluticasone furoate; mometasone, preferably mometasone furoate. In one aspect, the method comprises jet milling mometasone, preferably mometasone furoate in the presence of a liquid aerosol.

Suitable anticholinergics include: aclidinium, preferably aclidinium bromide; glycopyrronium, preferably glycopyrronium bromide; ipratropium, preferably ipratropium bromide; oxitropium, preferably oxitropium bromide; tiotropium, preferably tiotropium bromide; umeclidinium, preferably umeclidinium bromide; Darotropium bromide; or tarafenacin.

The medicaments may be double or triple combinations such as salmeterol xinafoate and fluticasone propionate; budesonide and formoterol fumarate dihydrate glycopyrrolate and indacaterol maleate; glycopyrrolate, indacaterol maleate and mometasone furoate; fluticasone furoate and vilanterol; vilanterol and umclidinium bromide; fluticasone furoate, vilanterol and umclidinium bromide.

The invention claimed is:

1. A process for producing a blister strip for a dry powder inhaler, the blister strip comprising a base material having blister cavities, the process comprising:

dosing a first formulation of medicament into a first set of the blister cavities;

sealing a first lid material to the first set of blister cavities; and subsequently dosing a second, different formulation of medicament into a second set of the blister cavities;

sealing a second, separate lid material to the second set of blister cavities.

2. The process according to claim 1, wherein the base material is a sheet having a plurality of rows of blister cavities, and the first and second sets of cavities each comprises one or more of the rows.

3. The process according to claim 2, wherein the base material is a continuous sheet that is passed along a process line which comprises:

a forming station for forming the blister cavities in the base material;

a first filling head, for dosing the first formulation into the first set of blister cavities;

a first sealing tool for sealing the first lid material to the first set of blister cavities;

a second filling head for dosing the second formulation into the second set of blister cavities;

a second sealing tool for sealing the second lid material to the second set of blister cavities;

and cutting means for cutting the base material into blister strips.

4. The process according to claim 3, wherein the process line further comprises an air jet or vacuum cleaning head between the first sealing tool and the second filling head.

5. The process according to claim 3, wherein the first lid material is applied transversely.

6. The process according to claim 3, wherein the first lid material is applied longitudinally and has holes that correspond to the second set of blister cavities.

7. The process according to claim 5, wherein the second lid material is applied transversely.

8. The process according to claim 5, wherein the second lid material is applied longitudinally.

9. The process according to claim 8, wherein the second lid material has holes that correspond to the first set of blister cavities.

10. The process according to claim 6, wherein the second lid material is applied transversely.

11. The process according to claim 6, wherein the second lid material is applied longitudinally.

12. A blister strip for a dry powder inhaler comprising a base material having blister cavities, wherein a first set of the blister cavities contains a first formulation of medicament covered by a first lid material and a second set of the blister cavities contains a second, different formulation of medicament covered by a second, separate lid material.

13. The blister strip according to claim 12, wherein the first and second sets of blister cavities are arranged in an alternating pattern.

14. The blister strip according to claim 12, wherein the first and second sets of blister cavities are each arranged in pairs and the pairs form an alternating pattern.

15. The blister strip according to claim 12, wherein the first and second lid materials are in the form of discrete pieces which cover each blister cavity or each pair of blister cavities.

16. The blister strip according to claim 12, wherein the first lid material is in the form of discrete pieces which cover each blister cavity or each pair of blister cavities containing the first formulation and the second lid material is in the form of a continuous piece.

17. A The blister strip according to claim 12, wherein the first lid material is in the form of a continuous piece that covers each blister cavity or each pair of blister cavities containing the first formulation and has holes that correspond to the second set of blister cavities; and the second lid material is in the form of a continuous piece.

18. The blister strip according to claim 16, wherein the second lid material is in the form of a continuous piece that has holes that correspond to the first set of blister cavities.

19. The blister strip according to claim 17, wherein the second lid material is in the form of a continuous piece that has holes that correspond to the first set of blister cavities.

* * * * *